US007225505B2

(12) United States Patent
Bosses

(10) Patent No.: US 7,225,505 B2
(45) Date of Patent: Jun. 5, 2007

(54) VACUUM CLEANER NOZZLE INCLUDING MECHANICAL BEATER SONIC BEATER

(76) Inventor: Mark D. Bosses, 10 Blus Sky La., Montvale, NJ (US) 07645

( * ) Notice: Subject to any disclaimer, the term of this patent is extended or adjusted under 35 U.S.C. 154(b) by 319 days.

(21) Appl. No.: 10/871,461

(22) Filed: Jun. 18, 2004

(65) Prior Publication Data

US 2005/0278890 A1 Dec. 22, 2005

(51) Int. Cl.
*A47L 9/04* (2006.01)

(52) U.S. Cl. ..... 15/364; 15/382

(58) Field of Classification Search ..... 15/364, 15/382, 404
See application file for complete search history.

(56) References Cited

U.S. PATENT DOCUMENTS

| | | | | |
|---|---|---|---|---|
| 1,792,992 | A * | 2/1931 | Lerch | 15/382 |
| 1,970,355 | A * | 8/1934 | Bennett | 15/364 |
| 2,008,972 | A * | 7/1935 | Taylor | 15/382 |
| 2,233,252 | A * | 2/1941 | Eckert | 15/382 |
| 2,251,562 | A * | 8/1941 | Belpedio | 15/364 |
| 2,253,309 | A * | 8/1941 | Smellie | 15/364 |
| 2,581,794 | A * | 1/1952 | Hodges | 15/364 |
| 2,825,925 | A | 3/1958 | Acheson | |
| 2,932,054 | A | 4/1960 | Lichtgarn | |
| 3,071,145 | A | 1/1963 | Blanchard | |
| 3,364,627 | A * | 1/1968 | Wright | 15/50.1 |
| 3,750,221 | A | 8/1973 | Meyerhoefer | |
| 4,223,417 | A | 9/1980 | Solow | |
| 4,853,567 | A | 8/1989 | Muramatsu et al. | |
| 4,972,574 | A | 11/1990 | Isono et al. | |
| 5,249,328 | A | 10/1993 | Shin | |
| 5,311,632 | A | 5/1994 | Center | |
| 5,400,466 | A | 3/1995 | Alderman et al. | |
| 5,738,575 | A | 4/1998 | Bock | |
| 5,934,908 | A | 8/1999 | Woog et al. | |
| 5,974,615 | A | 11/1999 | Schwarz-Hartmann | |
| 6,108,853 | A | 8/2000 | Dittus | |
| 6,161,251 | A | 12/2000 | Lee et al. | |
| 6,622,333 | B1 | 9/2003 | Rehkemper et al. | |

* cited by examiner

*Primary Examiner*—Theresa T. Snider
(74) *Attorney, Agent, or Firm*—Amster, Rothstein & Ebenstein LLP

(57) ABSTRACT

A vacuum cleaner nozzle including a nozzle head, the nozzle head having at least one mechanical beater and at least one sonic beater.

24 Claims, 6 Drawing Sheets

VACUUM CLEANER NOZZLE INCLUDING MECHANICAL BEATER SONIC BEATER

FIELD OF THE INVENTION

The present disclosure relates to vacuum cleaners and, more particularly, to vacuum cleaners having beaters that agitate and dislodge dirt from a surface to be cleaned.

BACKGROUND OF THE INVENTION

It is well known in the vacuum cleaner art to provide a suction nozzle which is movable across an object to be cleaned. The suction effect created at an opening in the nozzle results in the removal of free dirt particles accumulated on the object. However, ground in dirt is frequently encountered when cleaning carpets or other textured surfaces, and reliance on simple suction for removal of such ground-in dirt has proven to be unsatisfactory.

Accordingly, effort has been made to provide vacuum cleaners with an effective means to beat the carpet surface to dislodge ingrained dirt particles. Such beaters are often located on the vacuum cleaner nozzle head, so that dirt can be dislodged and instantly removed by simply moving the nozzle head across a soiled carpet surface. The earliest known beaters are mechanical beaters, which physically strike the carpet surface to loosen dirt particles. An example of a mechanical beater is disclosed in U.S. Pat. No. 6,108,853, which includes a cylindrical rotatable beater brush having a plurality of extending resilient bristles and prongs that physically beat the carpet as the nozzle head is moved. U.S. Pat. No. 6,161,251 to Lee et al. uses a mechanical vibration generating device that vibrates using air sucked though a supplementary suction hole to beat the carpet. In various embodiments, the vibration generating device can be used to vibrate the nozzle body which in turn vibrates the surface to be cleaned or the vibration generating device can directly beat the surface.

Later, "sonic beaters" were developed, which rely on fluctuation in air flow through the nozzle opening to dislodge dirt particles. For example, U.S. Pat. No. 2,932,054 to Lichtgarn discloses a vacuum cleaner in which the vibration of disks produces a vibrating column of air that loosens dirt in a carpet. Similarly, U.S. Pat. No. 5,400,466 to Alderman et al. discloses an air vibration suction nozzle that includes a speaker that vibrates the suction air and a means for adjusting the frequency and amplitude of the airwaves produced by the speaker.

Although sonic beaters avoid physical damage to a carpet often caused by mechanical beaters, they are not as effective in dislodging dirt on the surface of a carpet pile. At the same time, mechanical beaters are not as effective in removing particles embedded deeply in the carpet pile. Also, mechanical beaters tend to push dirt particles down into the carpet, thereby making it more difficult to effectively clean the carpet. Accordingly, there is a need for a beater construction that can provide a vacuum cleaner with a more thorough cleaning action.

SUMMARY OF THE INVENTION

One aspect of this invention provides a vacuum cleaner nozzle that allows a vacuum cleaner to exhibit an improved cleaning action.

Another aspect of this invention provides a vacuum cleaner nozzle that allows for an improved cleaning action regardless of the direction in which a user pushes the vacuum cleaner nozzle.

Another aspect of this invention provides a vacuum cleaner nozzle that thoroughly cleans surface fibers and deep fibers of a carpet by effectively dislodging dirt particles at all depths of the carpet pile.

Another aspect of this invention provides a vacuum cleaner nozzle including a mechanical beater that effectively removes imbedded dirt without driving dirt particles deeper into the surface to be cleaned.

A vacuum cleaner nozzle according to an exemplary embodiment of the invention includes a nozzle head having at least one mechanical beater and at least one sonic beater.

A vacuum cleaner according to an exemplary embodiment of the invention includes a dust collecting part and a nozzle connected to the dust collecting part, the nozzle including a nozzle head, the nozzle head having at least one mechanical beater and at least one sonic beater.

In at least one embodiment of the invention, the nozzle head further includes a nozzle opening, and the at least one mechanical beater is disposed at the nozzle opening and the at least one sonic beater is disposed in front of or behind the nozzle opening.

In at least one embodiment of the invention, the at least one sonic beater includes a first sonic beater and a second sonic beater, and the first sonic beater is disposed in front of the at least one mechanical beater and the second sonic beater is disposed behind the at least one mechanical beater.

In at least one embodiment of the invention, the sonic beater includes a vibrator.

In at least one embodiment of the invention, the sonic beater includes a beater portion and an ultrasonic actuating member that rotates and vibrates the beater portion.

In at least one embodiment of the invention, the mechanical beater includes a rotatable beater brush.

In at least one other embodiment of the invention, the mechanical beater includes a diaphragm biased by at least one spring.

These and other features of this invention are described in, or are apparent from, the following detailed description of various exemplary embodiments of this invention.

BRIEF DESCRIPTION OF THE FIGURES

Various exemplary embodiments of this invention will be described in detail, with reference to the following figures, wherein.

DETAILED DESCRIPTION OF PREFERRED EMBODIMENTS

Various exemplary embodiments of the present invention relate to a vacuum cleaner including at least one mechanical beater and at least one sonic beater. For purposes of the present description, the term "sonic beater" refers to a beating mechanism that relies on no or little direct physical contact with the surface to be cleaned to achieve the requisite cleaning action. In various exemplary embodiments of the invention, a sonic beater causes fluctuations in the air flow through a vacuum nozzle to loosen dirt embedded in a soiled surface. In various other exemplary embodiments of the invention, a sonic beater rapidly vibrates while barely contacting the surface to be cleaned to pre-loosen embedded dirt to allow a mechanical beater in the same nozzle head to operate more effectively. A mechanical beater used in conjunction with a sonic beater allows for a more effective cleaning action. For example, when cleaning carpet, the mechanical beater brush helps to loosen dirt located on the upper portion or surface of the carpet's pile while the sonic beater helps to loosen the embedded dirt located in the lower portion of the carpet's pile. Further, the use of both sonic and mechanical beaters can permit the use of softer bristles on a mechanical brush to reduce the wear and tear on the carpet caused by the rotating mechanical brush.

In the present disclosure, like reference numbers refer to like elements throughout the drawings, which illustrate various exemplary embodiments of the invention.

Figure 1:
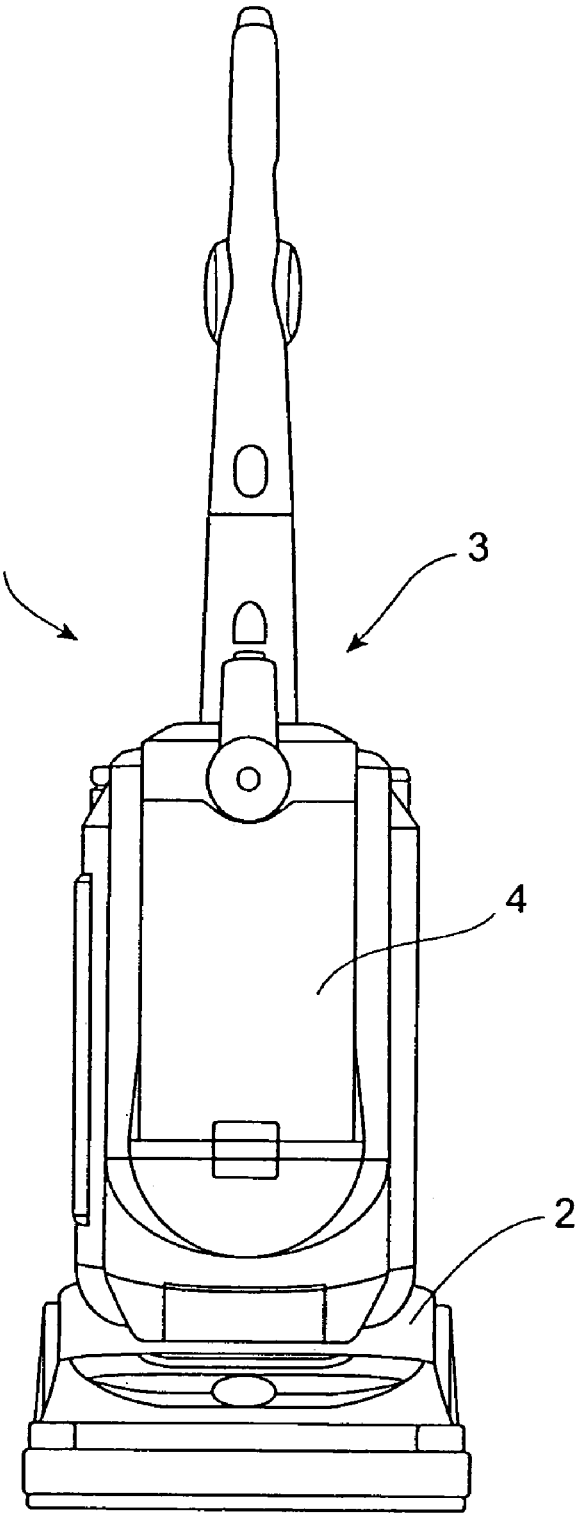
FIG. 1 shows a vacuum cleaner according to an exemplary embodiment of the invention.

FIG. 1 shows generally a vacuum cleaner according to an exemplary embodiment of the present invention. As shown in FIG. 1, the vacuum cleaner 1 includes a nozzle 2, a vacuum cleaner body 3, and a dust collecting part 4. The nozzle 2 may include a motor (not shown) that generates a suction force and which can also be used to actuate various components within the nozzle 2, as described in greater detail below.

Figure 2:
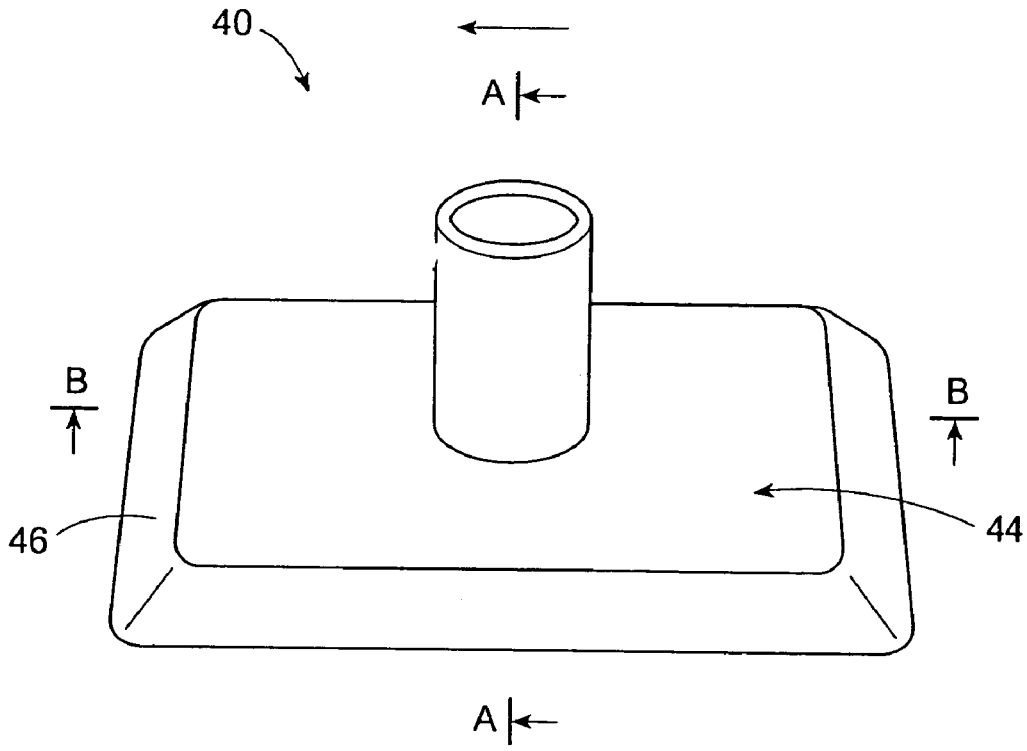
FIG. 2 is a top plan view of a vacuum cleaner nozzle according to an exemplary embodiment of the invention.
Figure 3:
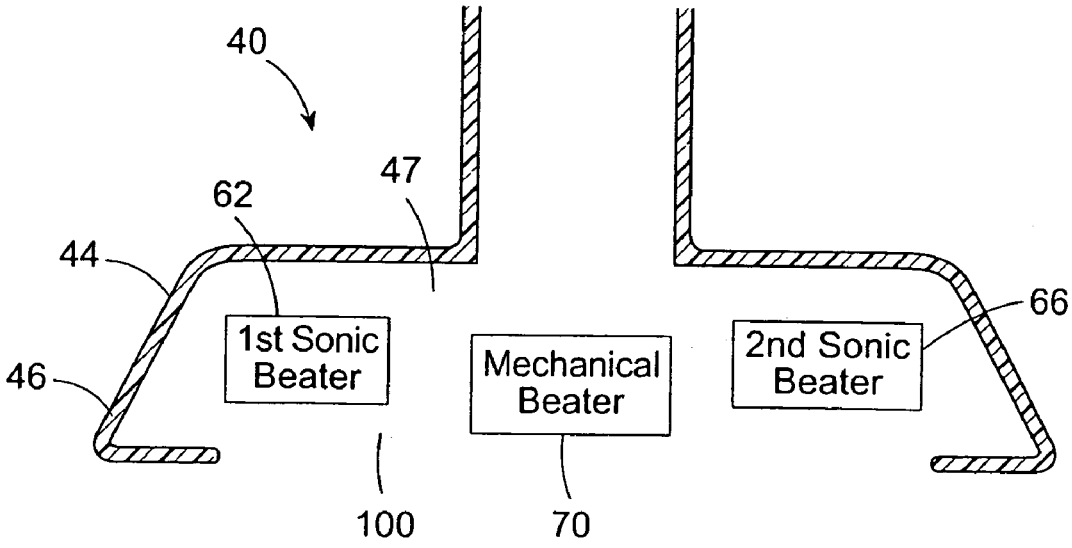
FIG. 3 is a vertical sectional view taken along the line A—A of FIG. 2 illustrating a vacuum cleaner nozzle according to a first exemplary embodiment of the invention.

FIG. 2 illustrates generally a top plan view of the nozzle 40. FIG. 3 is a schematic vertical sectional view taken along the line A—A of FIG. 2 illustrating an exemplary embodiment of the invention.

As shown in FIG. 2, the nozzle 40 includes a nozzle head 44. The nozzle head 44 includes a casing 46 that is cast or molded from any suitable material, such as, for example, plastic. The casing 46 defines a hollow chamber 47 within the nozzle head 44. A nozzle opening 100 is formed in the casing 46 and extends substantially widthwise across the bottom of the casing 46. The nozzle opening 100 is in communication with the chamber 47 defined by the casing 46.

In the present exemplary embodiment of the invention, a first sonic beater 62, a mechanical beater 70 and a second sonic beater 66 are located in the chamber 47 of the nozzle head 44. However, in other exemplary embodiments, the nozzle head 44 can include any suitable number of sonic beaters and mechanical beaters so that the nozzle head 44 is able to dislodge and remove dirt embedded within the surface to be cleaned. Preferably, as shown in FIG. 3, the first sonic beater 62 is located at the front portion of the nozzle head 44 in front of the mechanical beater 70 and the nozzle opening 100, and the second sonic beater 66 is located in the back portion of the nozzle head 44 behind the mechanical beater 70 and the nozzle opening 100. Such an arrangement of the beaters allows the vacuum 1 to effectively loosen and suck up embedded dirt regardless of the direction of movement of the nozzle 40. However, other embodiments of the invention can include any suitable arrangement of sonic and mechanical beaters. In the exemplary embodiment shown in FIG. 3, any known or later discovered mechanical and sonic beaters can be incorporated into the nozzle head structure.

The following exemplary embodiments are provided to illustrate in more detail the various types of mechanical and sonic beater structures that can be used in the present invention, and are not meant to limit in any way the type or arrangement of such beaters.

Figure 4:
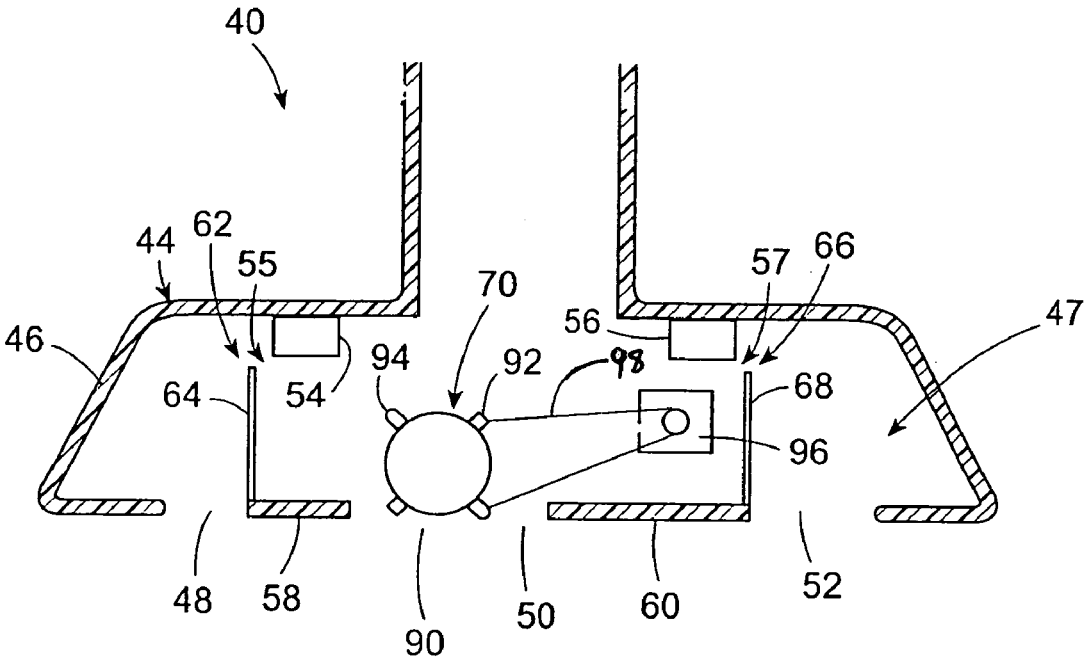
FIG. 4 is a vertical sectional view taken along the line A—A of FIG. 2 illustrating a vacuum cleaner nozzle according to a second exemplary embodiment of the invention.

FIG. 4 is a vertical sectional view taken along the line A—A of FIG. 2 according to an exemplary embodiment of the invention.

As shown in FIG. 4, a first opening 48, a second opening 50 and a third opening 52 are formed in the casing 46 each extending substantially widthwise across the bottom of the casing 46. The first opening 48, second opening 50 and third opening 52 are in communication with the chamber 47 defined by the casing 46. In the present embodiment of the invention, the first opening 48, the second opening 50 and the third opening 52 form a first nozzle opening, a second nozzle opening and a third nozzle opening, respectively. A first crosspiece 58 extends between the first opening 48 and the second opening 50, and a second crosspiece 60 extends between the second opening 50 and the third opening 52. A first extending portion 54 is formed at the front portion of the nozzle head 40 and extends from the bottom surface of the upper portion of the casing 46. A second extending portion 56 is formed at the back portion of the nozzle head 44 and extends from the bottom surface of the upper portion of the casing 46. The first extending portion 54 and the second extending portion 56 form a first narrowed portion 55 and second narrowed portion 57, respectively, of the chamber 47.

In the present exemplary embodiment of the invention, a first sonic beater 62, a mechanical beater 70 and a second sonic beater 66 are located in the chamber 47 of the nozzle head 44. Preferably, as shown in FIG. 4, the first sonic beater 62 is located at the front portion of the nozzle head 44 in front of the mechanical beater 70 and the second sonic beater 66 is located in the back portion of the nozzle head 44 behind the mechanical beater 70. Such an arrangement of the beaters allows the vacuum 1 to effectively loosen and suck up embedded dirt regardless of the direction of movement of the nozzle 40.

The first sonic beater 62 includes a first vibrator 64 disposed on the first crosspiece 58 transverse to the first nozzle opening 48 and proximate and in front of the first narrowed portion 55 of the chamber 47. The first vibrator 64 is preferably made of a flexible material, such as, for example, rubber. The operation of the first sonic beater is such that there is no physical striking of the carpet surface to dislodge ground-in dirt particles. Rather, when the vacuum motor is energized, the air stream flowing over the top of the first vibrator 64 causes it to move as indicated by the dash lines in FIG. 5. Preferably, the first vibrator 64 closely matches in contour and size the first narrowed portion 55 of the chamber 47. The cross-sectional areas of the first narrowed portion 55 and the second narrowed portion 57 are much reduced in comparison to other portions of the chamber 47. As a consequence of the close matching of the first vibrator 64 with the first narrowed portion 55, the movement of the first vibrator 64 alternately decreases and increases the size of the passage between the first narrowed portion 55 and the first nozzle opening 48. This causes the suction pressure to alternately rise and fall while at the same time, and as a direct result, the velocity of air flow increases and decreases alternately and in rapid succession. The free end of the first vibrator 64 snaps back and forth in the manner of a "cracking whip", thus making the changes in air pressure and air velocity extremely abrupt. The vibratory air zone or column passing through the first nozzle opening 48 as a result of the movement of the first vibrator 64 dislodges and shakes the dirt loose within the effective suction area of the vacuum 1, so that as the dirt is loosened, it can be carried off by the suction.

The second sonic beater 66 includes a second vibrator 68 disposed on the second crosspiece 60 transverse to the third nozzle opening 48 and proximate and behind the second narrowed portion 57 of the chamber 47. The second sonic beater 66 operates substantially the same as the first sonic beater 62 to loosen and remove embedded dirt.

The mechanical beater 70 is disposed between the first sonic beater 62 and the second sonic beater 66. In the present exemplary embodiment of the invention, the mechanical beater 70 includes a conventional rotatable beater brush structure 90 rotatably mounted to the casing 46. A drive motor 96 is mounted on the casing 46 behind the rotatable beater brush structure 90. The drive motor 96 generates power to drive the rotatable beater brush structure 90 via a belt 98 that connects drive motor 96 to the rotatable beater brush structure 90. As well known in the art, the rotatable beater brush structure 90 is a cylindrically shaped roller that carries a plurality of brush strips 92 and beater strips 94. Each brush strip 92 includes a plurality of brush bundles (not shown) spaced apart from each other for agitating the surface being cleaned upon rotation of the beater brush structure 90. Each beater strip 94 includes a plurality of relatively rigid projections (not shown) which become engaged with the surface being cleaned upon rotation of the beater brush structure 90.

As described above, the first sonic beater 62, the mechanical beater 70 and the second sonic beater 66 of the nozzle head 44 work in conjunction to dislodge and remove dirt as the nozzle head 44 is moved across a soiled surface in a back and forth motion. For example, as the nozzle head 44 is moved forwards and backwards across a carpet, the first sonic beater 62 helps first to loosen dirt embedded deeply in the carpet's pile, then the mechanical beater dislodges dirt on the upper portion or surface of the carpet's pile, allowing for a more thorough cleaning action. It should be appreciated that the detailed descriptions of the sonic and mechanical beaters are provided in this disclosure merely as exemplary structure, and one having ordinary skill in the art would understand that any suitable type of mechanical and sonic beaters can be incorporated into a nozzle head to form various other exemplary embodiments of the invention. As discussed, it is a combination of both a mechanical beater and a sonic beater that provides a vacuum cleaner according to preferred embodiments of this invention with an improved cleaning action.

Figure 5:
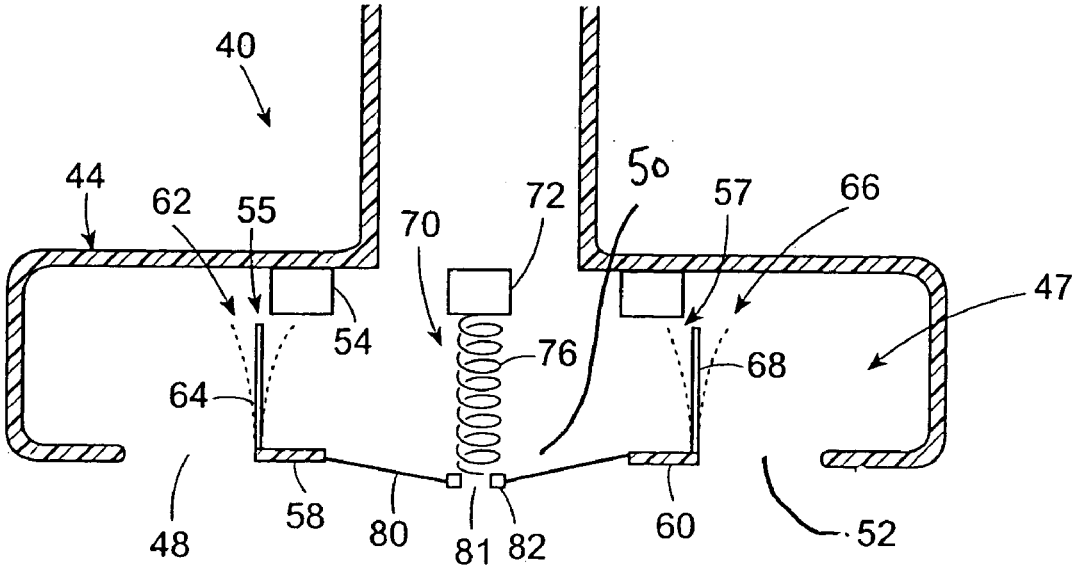
FIG. 5 is a vertical sectional view taken along line A—A of FIG. 2 illustrating a vacuum cleaner nozzle according to a third exemplary embodiment of the invention.
Figure 6:
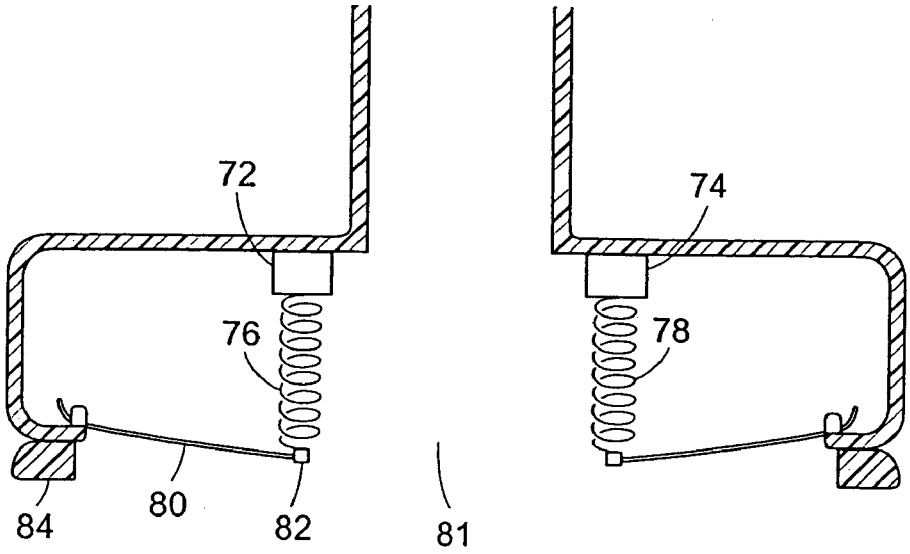
FIG. 6 is a vertical sectional view taken along line B—B of FIG. 2 illustrating the vacuum cleaner nozzle according to the third exemplary embodiment of the invention.
Figure 7:
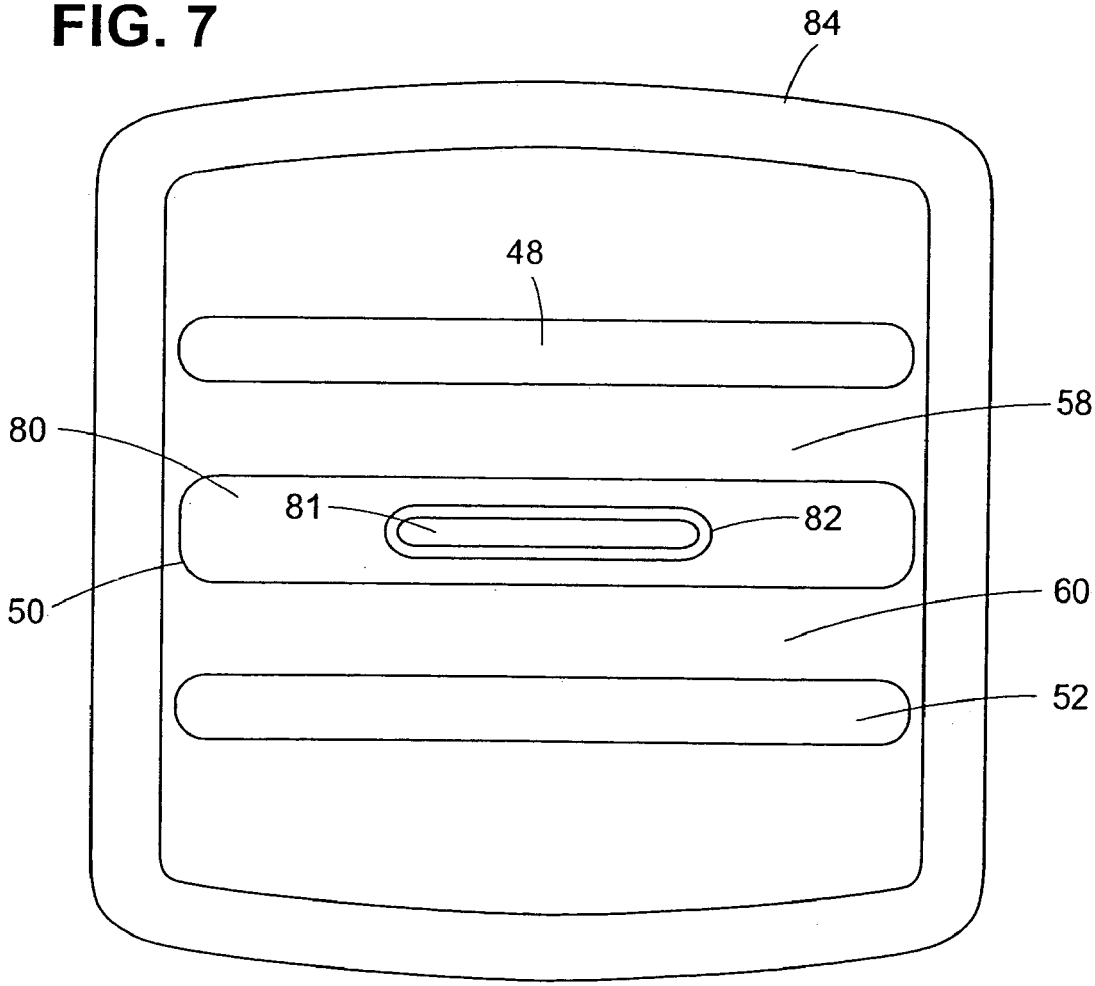
FIG. 7 is a bottom plan view of the vacuum cleaner nozzle according to the third exemplary embodiment of the invention.

FIGS. 5–7 illustrate a vacuum nozzle structure according to another exemplary embodiment of the invention. FIG. 5 is a vertical sectional view taken along the line A—A of FIG. 2, FIG. 6 is a vertical sectional view taken along the line B—B of FIG. 2, and FIG. 7 is a bottom plan view of the nozzle 40.

The present embodiment of the invention is substantially the same as the previous embodiment except for the structure of the mechanical beater 70. As in the previous embodiment, a first opening 48, a second opening 50 and a third opening 52 are formed in the casing 46 each extending substantially widthwise across the bottom of the casing 46. The first opening 48, second opening 50 and third opening 52 are in communication with the chamber 47 defined by the casing 46. The first opening 48 and the third opening 52 form a first nozzle opening and a second nozzle opening, respectively. Also, similar to the previous embodiment of the invention, a first sonic beater 62, a mechanical beater 70 and a second sonic beater 66 are located in the chamber 47 of the nozzle head 44. The first sonic beater 62 includes a first vibrator 64 disposed on the first crosspiece 58 transverse to the first nozzle opening 48 and proximate and in front of the first narrowed portion 55 of the chamber 47. The second sonic beater 66 includes a second vibrator 68 disposed on the second crosspiece 60 transverse to the third nozzle opening 48 and proximate and behind the second narrowed portion 57 of the chamber 47.

The mechanical beater 70 is disposed between the first sonic beater 62 and the second sonic beater 66. As shown in FIGS. 5–6, the mechanical beater 70 according to the present embodiment of the invention includes a diaphragm 80, a first compression spring 76 and a second compression spring 78. The diaphragm 80 extends across the second opening 50 in the nozzle head 44 from the inner end of the first crosspiece 58 to the inner end of the second crosspiece 60. The diaphragm 80 is preferably formed of a flexible material, such as, for example, rubber or plastic. As best shown in FIG. 7, the diaphragm 80 has an opening 81 extending substantially widthwise across the nozzle head 44 and located at the central area of the diaphragm 80. The opening 81 forms a second nozzle opening. The edges of the second nozzle opening 81 are preferably reinforced by a metal or plastic rim 82 secured to the diaphragm in any suitable manner, such as by rivets.

As shown in FIG. 6, the upper ends of the first compression spring 76 and the second compression spring 78 are anchored to a first spring support 72 and a second spring support 74, respectively, which extend from the lower surface of an upper portion of the casing 46. The lower ends of the first compression spring 76 and the second compression spring 78 are fixed to the rim 82 at opposite ends of the second nozzle opening 81. The operation of the mechanical beater 70 is described below.

When the suction motor is energized, since the rim 82 surrounding the second nozzle opening 81 is held sealed against the carpet by first and second springs 76 and 78, the suction produced in chamber 47 becomes effective to lift the diaphragm 80 in opposition to the first and second springs 76 and 78 as a consequence of the higher air pressure acting on the lower face of the diaphragm. A downwardly extending skid 84 disposed on the outer bottom surface of the casing 46 prevents the diaphragm 80 from sealing to the carpet at its outer edges. The air gap between the skid 84 and the rim 82 ensures that the lower face of the diaphragm 80 will be open to the atmosphere to maintain a pressure differential across the diaphragm 80. The diaphragm 80 rises and leaves the carpet to break the seal between the carpet and the rim 82 allowing atmospheric air to rapidly enter second nozzle opening 81. As a result, the air pressure within chamber 47 sharply increases, which, along with the energy stored in the first and second springs 72 and 74, causes the diaphragm 80 to snap downwardly, bringing the rim 82 into abrupt contact with the carpet. The diaphragm 80 cycles rapidly and with great force due to the alternately increasing and decreasing pressure differential acting on the opposing faces of the diaphragm 80. As a result, the rim 82 attached to the diaphragm 80 rapidly beats the carpet to dislodge dirt which is immediately sucked into the second nozzle opening 81.

Figure 8:
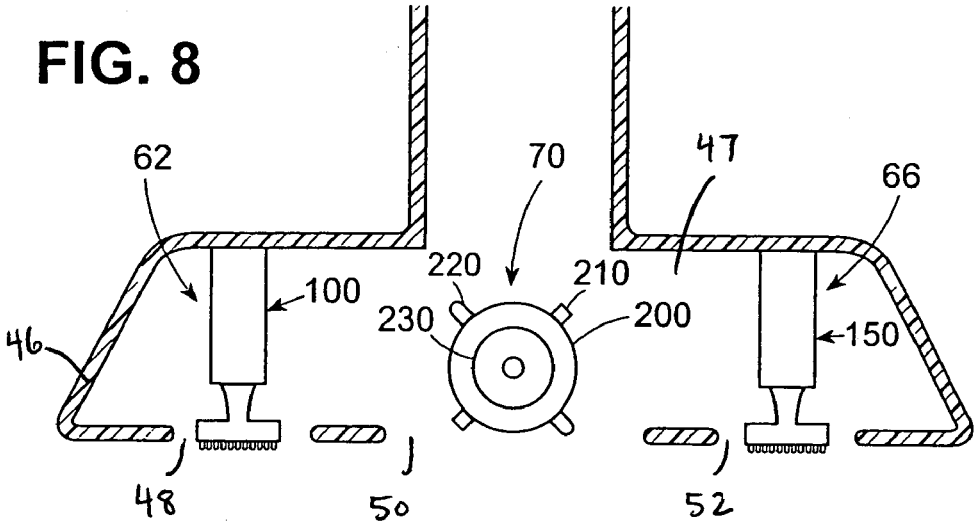
FIG. 8 is a vertical sectional view taken along line A—A of FIG. 2 illustrating a vacuum cleaner nozzle according to a fourth exemplary embodiment of the invention.
Figure 9:
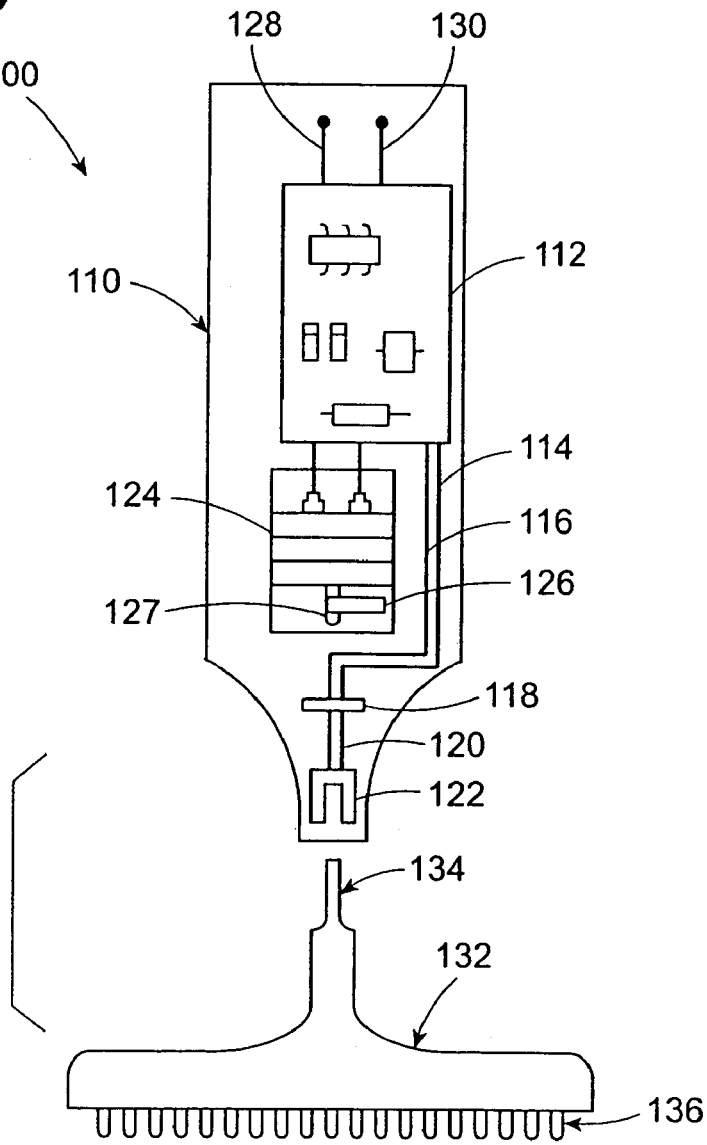
FIG. 9 is a vertical sectional view of the ultrasonic agitator 100 of FIG. 8.
Figure 10:
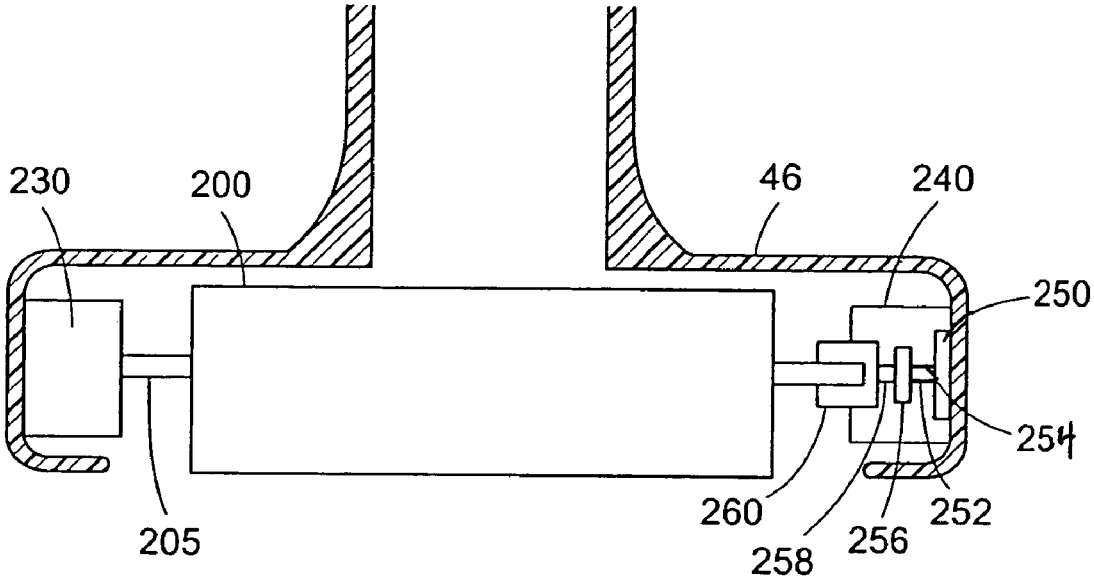
FIG. 10 is a vertical sectional view taken along line B—B of FIG. 2 illustrating the vacuum cleaner nozzle according to the fourth exemplary embodiment of the invention.

FIGS. 8 and 9 illustrate a vacuum nozzle structure according to another exemplary embodiment of the invention. FIG. 8 is a vertical sectional view taken along the line A—A of FIG. 2, and FIG. 9 is a vertical sectional view taken along the line B—B of FIG. 2.

In the present embodiment of the invention, the first sonic beater 62 and second sonic beater 66 include ultrasonic beating mechanisms that contact and vibrate the surface to be cleaned at a rapid rate to pre-loosen ground in dirt so as to enhance the effectiveness of the mechanical beater 70. As in the previous embodiments, a first opening 48, a second opening 50 and a third opening 52 are formed in the casing 46 each extending substantially widthwise across the bottom of the casing 46. The first opening 48, second opening 50 and third opening 52 are in communication with the chamber 47 defined by the casing 46. The first opening 48, second opening 50 and third opening 52 form a first nozzle opening, a second nozzle opening and a third nozzle opening, respectively. Also, similar to the previous embodiment of the invention, a first sonic beater 62, a mechanical beater 70 and a second sonic beater 66 are located in the chamber 47 of the nozzle head 44. The first sonic beater 62 includes a first ultrasonic agitator 100 fixedly disposed on the lower surface of the upper portion of the nozzle head 44 above the first nozzle opening 48. The second sonic beater 66 includes a second ultrasonic agitator 150 fixedly disposed on the lower surface of the upper portion of the nozzle head 44 above the third nozzle opening 52. A more detailed description of the structure and operation of the ultrasonic agitators 100 and 150 according to the present embodiment of the invention is provided below.

As shown in FIG. 9, the first ultrasonic agitator 100 includes an ultrasonic actuating member 110 and a brush head 132. The brush head 132 includes a bristled end 136. The brush head 132 is set at a predetermined level so that the bristled end 136 will barely contact the surface to be cleaned while the vacuum cleaner 1 is in operation. The ultrasonic actuating member 110 includes an electric motor 124 to which is attached an eccentrically mounted member 126 via a rotatable shaft 127. The electric motor 124 is connected to a power source (not shown) via electrical conductors 128 and 130. When the vacuum cleaner 1 is turned on, the electric motor 124 will rotate eccentric member 126 and the entire ultrasonic agitator 100 will vibrate in a rotary direction. Because the ultrasonic actuating member 110 is fixed to the nozzle head 44 and the mass of the ultrasonic actuating member 110 is much greater than that of the brush head 132, the bristled end 136 of the brush head 132 will vibrate about a greater radius than that of the ultrasonic actuating member 110. Thus, the bristled end 136 will rotate at a rapid rate.

Also connected to the power source is an electronic circuit package 112 that produces high frequency oscillations which are coupled via lines 114 and 116 to an sonic transducer 118. The transducer 118 is in turn mechanically coupled via connector 120 to a holder 122 which is adapted to surround and frictionally secure within it an extension 134 the brush head 132. The sonic transducer 118 is preferably a commercially available device capable of producing a sonic wave in the frequency range of, for example, 10–20 MHz. The energy is coupled directly from the transducer 118 through the connector 120 which acts as a wave guide and into holder 122 from which it propagates into the brush head 132. Thus, the bristled end 136 of the brush head 132 vibrates while being caused to rotate by the rotating eccentric member 126. If the sonic transducer 118 causes the bristled end 136 to vibrate at a frequency larger than 20,000 Hz, the bristled end 136 may be said to be vibrating "ultrasonically", in which case the first sonic beater 62 may be referred to as an ultrasonic beater. This rapid motion of the brush head 132 agitates the dirt embedded in the surface to be cleaned, and therefore pre-loosens the dirt before the mechanical beater 70 passes over the surface. The mechanical beater 70 is then able to more effectively suck up the loosened dirt by a sweeping action. Also, because the bristled end 136 of the brush head 132 barely contacts the surface, the brush head 132 is able to agitate the dirt without grounding the dirt into the carpet.

The second ultrasonic agitator 150 of the second sonic beater 66 operates substantially the same as the first ultrasonic agitator 100 to pre-loosen ground in dirt so that the mechanical beater 70 will function more effectively.

In the present embodiment of the invention, the ultrasonic agitators are not limited to a brush head having a bristled end. Any suitable structure, such as, for example, a roller or a straight bar that can be ultrasonically actuated to agitate the carpet to pre-loosen dirt embedded in the carpet can be used.

The mechanical beater 70 of the present embodiment of the invention includes a generally cylindrical beater brush 200 that carries a plurality of brush strips 210 and a plurality of beater strips 220. A direct drive motor 230 drives the beater brush 200. As is generally known in the motor art, a direct drive motor drives a device or machine that is directly connected mechanically to the driving shaft of the motor without the use of belts or chains. Such a direct drive motor is characterized by its high resolution, high speed and dust-proof structure. The direct drive motor 230 is mounted in the casing 46 and rotatably drives the beater brush 200 via a drive axle 205. Each brush strip 210 includes a plurality of brush bundles (not shown) spaced apart from each other for agitating the surface being cleaned upon rotation of the beater brush 200 by the direct drive motor 230. Each beater strip 220 includes a plurality of rigid projections (not shown) which contact and in some cases engage with the surface being cleaned upon rotation of the beater brush 200.

As shown in FIG. 910, the drive axle 205 is also engaged with an ultrasonic agitator 240. The ultrasonic agitator 240 is mounted to the casing 46 and is operatively attached to the drive axle 205 opposite the direct drive motor 230. The ultrasonic agitator 240 includes an electronic circuit package 250 that produces high frequency oscillations which are coupled via lines 252 and 254 to an ultrasonic transducer 256. The transducer 256 is in turn mechanically coupled via connector 258 to a holder 260 which is adapted to surround and frictionally secure within it the drive axle 205. Thus, the ultrasonic waves caused by the transducer 256 are imparted to the drive axle 205, which in turn causes the cylindrical beater brush 200 to rapidly vibrate while rolling over the surface to be cleaned. This enhances the effectiveness of the beater brush 200 by allowing it to agitate and loosen embedded dirt without pushing the dirt further into the carpet. Thus, in the present embodiment of the invention, the overall cleaning ability of the nozzle head 44 in loosening and removing embedded dirt is improved by the use of both ultrasonic agitators 100, 150 and a vibrating cylindrical beater brush 200.

The ultrasonic agitators are not limited to the structures shown and described in the above embodiments, and any known or later discovered devices that impart sonic vibrations to the various beaters of the nozzle head to agitate and loosen embedded dirt can be used. Further, in other embodiments of the invention, sonic vibrations can be imparted to only the mechanical beater, so that the sonic beaters rapidly rotate without vibrating. In still other embodiments of the invention, sonic vibrations can be imparted to only the sonic beaters, and conventional mechanical beaters without sonic vibrations can be used. Also, in other exemplary embodiments of the invention, the sonic beaters can be caused to vibrate without rotation, so that a separate electric motor to actuate such rotation is not required. The present invention is intended to encompass any combination of mechanical and sonic beaters in a nozzle head of a vacuum cleaner, where the mechanical beaters and/or the sonic beaters are caused to sonically agitate the surface to be cleaned.

While the foregoing invention has been described in some detail for purposes of clarity and understanding, it will be appreciated by one skilled in the art from a reading of the disclosure that various changes in form and detail can be made without departing from the true scope of the invention in the appended claims.

What is claimed is:

1. A vacuum cleaner nozzle comprising a nozzle head, the nozzle head comprising at least one mechanical beater and at least one sonic beater, the at least one mechanical beater comprising a rotatable beater brush and a sonic agitator that vibrates the rotatable beater brush.

2. The vacuum cleaner nozzle of claim 1, wherein the at least one sonic beater comprises a first sonic beater and a second sonic beater, and the first sonic beater is disposed in front of the at least one mechanical beater and the second sonic beater is disposed behind the at least one mechanical beater.

3. The vacuum cleaner nozzle of claim 1, wherein the nozzle head further comprises a nozzle opening, and the at least one mechanical beater is disposed at the nozzle opening and the at least one sonic beater is disposed in front of or behind the nozzle opening.

4. The vacuum cleaner nozzle of claim 1, wherein the nozzle head comprises a casing that defines a chamber and that houses the at least one sonic beater and the at least one mechanical beater.

5. The vacuum cleaner nozzle of claim 4, wherein the at least one sonic beater comprises a vibrator.

6. The vacuum cleaner nozzle of claim 5, wherein the casing comprises at least one nozzle opening extending across the bottom of the casing and in communication with the chamber, and the vibrator extends transversely in relation to the at least one nozzle opening.

7. The vacuum cleaner nozzle of claim 4, wherein the at least one sonic beater comprises:

a beater portion; and an ultrasonic actuating member that rotates and vibrates the beater portion.

8. The vacuum cleaner nozzle of claim 7, wherein the beater portion is a beater brush.

9. The vacuum cleaner nozzle of claim 7, wherein the ultrasonic actuating member comprises an ultrasonic transducer.

10. The vacuum cleaner nozzle of claim 1, wherein the at least one mechanical beater further comprises a motor that drives the rotatable beater brush.

11. The vacuum cleaner nozzle of claim 10, wherein the motor is a direct drive motor.

12. A vacuum cleaner comprising:

a dust collecting part; and a nozzle connected to the dust collecting part, the nozzle comprising a nozzle head, the nozzle head comprising at least one mechanical beater and at least one sonic beater, the at least one mechanical beater comprising a rotatable beater brush and a sonic agitator that vibrates the rotatable beater brush.

13. The vacuum cleaner of claim 12, wherein the at least one sonic beater comprises a first sonic beater and a second sonic beater, and the first sonic beater is disposed in front of the at least one mechanical beater and the second sonic beater is disposed behind the at least one mechanical beater.

14. The vacuum cleaner of claim 13, wherein the nozzle head further comprises a nozzle opening, and the at least one mechanical beater is disposed at the nozzle opening and the at least one sonic beater is disposed in front of or behind the nozzle opening.

15. The vacuum cleaner of claim 13, wherein the nozzle head comprises a casing that defines a chamber and that houses the at least one sonic beater and the at least one mechanical beater.

16. The vacuum cleaner of claim 15, wherein the at least one sonic beater comprises a vibrator.

17. The vacuum cleaner of claim 16, wherein the casing comprises at least one nozzle opening extending across the bottom of the casing and in communication with the chamber, and the vibrator extends transversely in relation to the at least one nozzle opening.

18. The vacuum cleaner of claim 15, wherein the at least one sonic beater comprises:

a beater portion; and an ultrasonic actuating member that rotates and vibrates the beater portion.

19. The vacuum cleaner of claim 18, wherein the beater portion is a beater brush, the beater brush comprising a bristled end.

20. The vacuum cleaner of claim 18, wherein the ultrasonic actuating member comprises an ultrasonic transducer.

21. The vacuum cleaner of claim 12, wherein the at least one mechanical beater further comprises a motor that drives the rotatable beater brush.

22. The vacuum cleaner of claim 21, wherein the motor is a direct drive motor.

23. A vacuum cleaner nozzle comprising a nozzle head, the nozzle head comprising at least one mechanical beater and at least one sonic beater, the at least one sonic beater comprising a beater portion and a sonic actuating member that rotates and vibrates the beater portion.

24. A vacuum cleaner comprising:

a dust collecting part; and a nozzle connected to the dust collecting part, the nozzle comprising a nozzle head, the nozzle head comprising at least one mechanical beater and at least one sonic beater, the at least one sonic beater comprising a beater portion and a sonic actuating member that rotates and vibrates the beater portion.

* * * * *